US010995485B1

(12) United States Patent
Cochran

(10) Patent No.: US 10,995,485 B1
(45) Date of Patent: May 4, 2021

(54) ANCHOR APPARATUS AND METHOD

(71) Applicant: Mark Lee Cochran, Irvington, AL (US)

(72) Inventor: Mark Lee Cochran, Irvington, AL (US)

(73) Assignee: RFW Anchors LLC, Mobile, AL (US)

( * ) Notice: Subject to any disclaimer, the term of this patent is extended or adjusted under 35 U.S.C. 154(b) by 0 days.

(21) Appl. No.: 16/729,625

(22) Filed: Dec. 30, 2019

Related U.S. Application Data

(60) Provisional application No. 62/786,583, filed on Dec. 31, 2018.

(51) Int. Cl.
*E04B 1/41* (2006.01)
*E04B 2/02* (2006.01)
*E04B 1/38* (2006.01)

(52) U.S. Cl.
CPC ..... *E04B 1/40* (2013.01); *E04B 2/02* (2013.01); *E04B 2001/405* (2013.01); *E04B 2002/0247* (2013.01)

(58) Field of Classification Search
CPC ..... E04B 1/40; E04B 2/02; E04B 2001/405; E04B 2002/0247
See application file for complete search history.

(56) References Cited

U.S. PATENT DOCUMENTS 1,158,197 A * 10/1915 Francis ..... E04B 2/16 52/433
2,054,511 A * 9/1936 Hornicek ..... E04F 13/0803 52/774
2,103,569 A * 12/1937 Wallace ..... E04F 13/0803 52/714
2,300,258 A * 10/1942 Kublanow ..... E04F 13/0803 52/774
2,586,388 A * 2/1952 Schafroth ..... F16B 2/24 411/443
4,662,140 A * 5/1987 Porter ..... E04F 13/0885 52/385
6,098,363 A * 8/2000 Yaguchi ..... E04F 13/0801 52/385
6,602,574 B1 * 8/2003 Daton-Lovett ..... B65H 75/34 428/105
6,802,165 B1 * 10/2004 Passeno ..... E04F 13/0862 52/288.1
7,617,646 B2 * 11/2009 Losse ..... E04F 13/14 52/385
8,657,244 B2 * 2/2014 Sillik ..... E04B 1/7666 248/217.3
8,935,896 B2 * 1/2015 Tancredi ..... E04F 13/007 52/387
9,809,974 B1 * 11/2017 Brekke ..... E04B 1/003
10,041,257 B2 * 8/2018 Tancredi ..... E04B 2/32
(Continued)

*Primary Examiner* — Rodney Mintz
(74) *Attorney, Agent, or Firm* — J. Nevin Shaffer, Jr.

(57) ABSTRACT

An improved anchor apparatus and method consisting of a hanger configured for connection with a surface where the hanger has a length with a first end and a second end and an anchor in the hanger where the anchor is connected with the hanger along a first part of the anchor and where the anchor is releasably connected with the hanger along a second part of the anchor such that when the second part is disconnected from the hanger the second part of the anchor extends away from the surface of the hanger.

20 Claims, 5 Drawing Sheets

(56) References Cited

U.S. PATENT DOCUMENTS

| | | | | |
|---|---|---|---|---|
| 2008/0257646 | A1* | 10/2008 | Gat | E06C 9/14 182/223 |
| 2010/0276559 | A1* | 11/2010 | Sillik | E04B 1/7666 248/342 |
| 2013/0247495 | A1* | 9/2013 | Tancredi | E04B 2/32 52/479 |
| 2017/0306621 | A1* | 10/2017 | Laursen | E04B 1/24 |
| 2020/0190814 | A1* | 6/2020 | Hatzinikolas | E04F 13/0853 |

* cited by examiner

ANCHOR APPARATUS AND METHOD

CROSS REFERENCE TO RELATED APPLICATION

This application claims the benefit of previously filed U.S. provisional patent application No. 62/786,583 filed Dec. 31, 2018 for a "Brick Anchor Apparatus and Method". The Applicant hereby claims the benefit of this provisional application under 35 U.S.C. § 119. The entire content of this provisional application is incorporated herein by this reference

FIELD OF THE DISCLOSURE

The present invention pertains to an improved anchor apparatus and method consisting of a hanger configured for connection with a surface where the hanger has a length with a first end and a second end and an anchor in the hanger where the anchor is connected with the hanger along a first part of the anchor and where the anchor is releasably connected with the hanger along a second part of the anchor such that when the second part is disconnected from the hanger the second part of the anchor extends away from the surface of the hanger.

BACKGROUND OF THE INVENTION

By way of example only and not by limitation, in 2008, during the construction of a residential home, Applicant observed waste and inefficiencies in the utilization of the "prior art" brick ties used to support load bearing brick/masonry walls. The standard brick tie according to the prior art consists of a single piece of metal that is nailed to a wood surface such that a portion of it can be bent away from the surface and inserted between bricks laid in front of the tie so as to hold the brick surface in place against the wood support. Applicant specifically noted large numbers of prior art brick ties discarded to the ground during the application process and the resulting waste from unused ties. Applicant opined that this waste occurs when brick masons take a handful of ties, apply what they need to the wood frame, and then drop the remaining unused ties to the ground. Applicant also observed that the design of the ties as individual pieces cost the brick masons additional time in securing each of the ties to the frame.

Still further, Applicant has observed that the use of individual ties also inevitably introduces location errors and inconsistent spacing due to human error.

Thus, there is a need in the art for an anchor apparatus and method that addresses the aforementioned problems in a manner that is robust and flexible so as to accommodate a full spectrum of structures, shapes and dimensions and which provides accurate and repeatable anchor locations.

It therefore is an object of this invention to provide an improved anchor system that reduces application time, increases efficiency and accuracy and reduces waste.

SUMMARY

Accordingly, an improved anchor apparatus and method according to a preferred embodiment consists of a hanger configured for connection with a surface where the hanger has a length with a first end and a second end and an anchor in the hanger where the anchor is connected with the hanger along a first part of the anchor and where the anchor is releasably connected with the hanger along a second part of the anchor such that when the second part is disconnected from the hanger the second part of the anchor extends away from the surface of the hanger.

In one aspect, the invention further includes many anchors along the length of the hanger.

In another aspect, the hanger is flexible such that the hanger is configurable into a roll of hanger and extensible into a length of hanger.

In yet another aspect, the invention further includes a wire suspension device where the wire suspension device is configured for connection with the hanger.

In one aspect, there are more than one anchors on the hanger that are equally spaced apart along the hanger.

In other aspects, the hanger further includes a hole in the hanger; there are more than one holes in the hanger along the length of the hanger; the hole is located in the hanger outside of the anchor, and there are a plurality of holes and anchors in the hanger where each of the plurality of holes is located in the hanger and in-between the plurality of anchors along the hanger.

According to another embodiment, an improved anchor apparatus consists of a hanger configured for connection with a surface where the hanger has a length with a first end and a second end. And a plurality of anchors equally spaced apart along the hanger where each of the plurality of anchors are connected with the hanger along a first part of the anchor and where the anchor is releasably connected with the hanger along a second part of the anchor such that when the second part is disconnected from the hanger the second part of the anchor extends away from the surface of the hanger.

In another aspect, the hanger is flexible such that the hanger is configurable into a roll of hanger and extensible into a length of hanger.

In yet another aspect, the invention further includes a wire suspension device where the wire suspension device is configured for connection with the hanger.

In one aspect, there are more than one anchors on the hanger that are equally spaced apart along the hanger.

In other aspects, the hanger further includes a hole in the hanger; there are more than one holes in the hanger along the length of the hanger; the hole is located in the hanger outside of the anchor; and there are a plurality of holes and anchors in the hanger where each of the plurality of holes is located in the hanger and in-between the plurality of anchors along the hanger.

In a further aspect, the hanger includes a connector tab at one end of the hanger where the connector tab extends away from the hanger and where the connector tab includes a hole.

According to another embodiment, an improved anchor method consists of:

a. providing a hanger configured for connection with a surface where the hanger has a length with a first end and a second end; and an anchor in the hanger where the anchor is connected with the hanger along a first part of the anchor and where the anchor is releasably connected with the hanger along a second part of the anchor such that when the second part is disconnected from the hanger the second part of the anchor extends away from the surface of the hanger; and b. attaching the hanger to a first surface.

In another aspect, the method further includes disconnecting the second part of the anchor from the hanger and extending the second part away from the hanger and placing the second part of the anchor in-between two bricks.

In another aspect, the method further includes a wire suspension device where the wire suspension device is configured for connection with the hanger and connecting the wire suspension device with the hanger.

In another aspect, the method further includes a plurality of holes in the hanger where each of the plurality of holes is located in the hanger and in-between a plurality of anchors along the hanger.

DESCRIPTION OF THE DRAWINGS

Other objects, features and advantages of the present invention will become more fully apparent from the following detailed description of the preferred embodiment, the appended claims and the accompanying drawings in which:

DETAILED DESCRIPTION OF EMBODIMENTS

Figure 1:
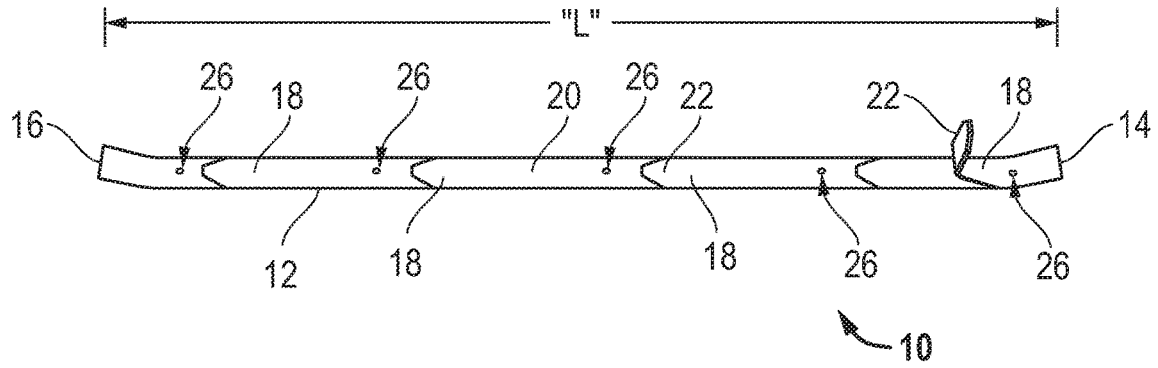
FIG. 1 is a top view of the improved anchor hanger in a flat form with an anchor extended.

Before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the invention be regarded as including equivalent constructions to those described herein insofar as they do not depart from the spirit and scope of the present invention.

For example, the specific sequence of the described method may be altered so that certain steps are conducted in parallel or independent, with other steps, to the extent that the steps are not dependent upon each other. Thus, the specific order of steps described herein is not to be considered implying a specific sequence of steps to perform the process. In alternative embodiments, one or more steps may be implemented by a user assisted process and/or manually. Other alterations or modifications of the above method are also contemplated. For example, further insubstantial approximations of the steps are also considered within the scope of the processes described herein.

In addition, features illustrated or described as part of one embodiment can be used on other embodiments to yield a still further embodiment. Additionally, certain features may be interchanged with similar devices or features not mentioned yet which perform the same or similar functions. It is therefore intended that such modifications and variations are included within the totality of the present invention.

It should also be noted that a plurality of hardware devices, as well as a plurality of different structural components, may be utilized to implement the invention. Furthermore, and as described in subsequent paragraphs, the specific configurations illustrated in the drawings are intended to exemplify embodiments of the invention and that other alternative configurations are possible.

One embodiment of the present invention is illustrated by way of examples in FIGS. 1-8. With specific reference to FIGS. 1 and 2, an improved anchor apparatus and method 10 according to a preferred embodiment consists of a hanger 12 configured for connection with a surface where the hanger 12 has a length "L" with a first end 14 and a second end 16 and an anchor 18 in the hanger 12. As used herein, the term "anchor" describes a portion of the hanger 12 that is useful for securing the hanger 12 to another object as will be described more fully hereafter. The anchor 18 is connected with the hanger 12 along a first part 20 of the anchor 18 and the anchor 18 is releasably connected with the hanger 12 along a second part 22 of the anchor 18 such that when the second part 22 is disconnected from the hanger 12 the second part 22 of the anchor 18 extends away from the surface of the hanger 12 as shown. Preferably, anchors 18 are spaced equally along the length "L" of hanger 12 as shown.

Figure 2:
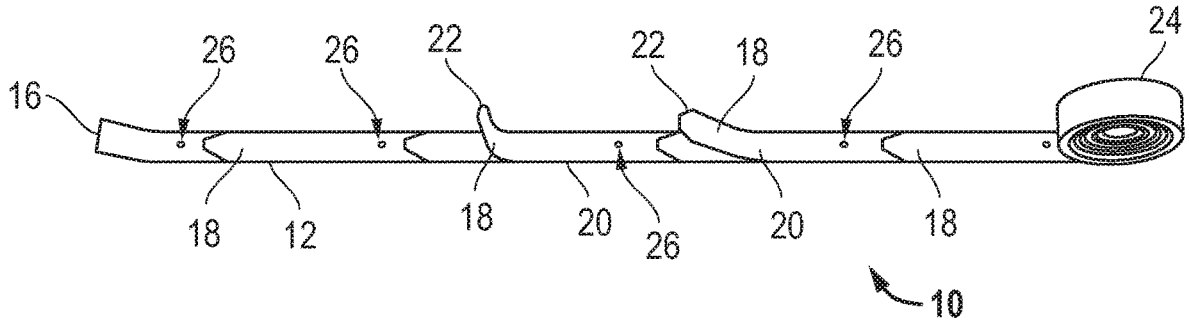
FIG. 2 is a perspective view of the invention of FIG. 1 partially in a roll with two anchors extended.

As shown in FIGS. 1 and 2, preferably the invention includes many anchors 18 along the length "L" of the hanger 12. In another aspect, the hanger 12 is flexible such that the hanger 12 is configurable into a roll 24 of hanger 12 and extensible into a length "L" of hanger 12 as illustrated.

Still further hanger 12 includes a hole 26 and, preferably, holes 26 along the length "L" of hanger 12. The holes 26 are preferably located outside of, that is not within or in, anchor 18. Holes 26 provide a guide and location for connecting hanger 12 to a structure 28 (see FIGS. 3, 4 and 5) with a nail, screw or other attachment as deemed most useful.

Figure 3:
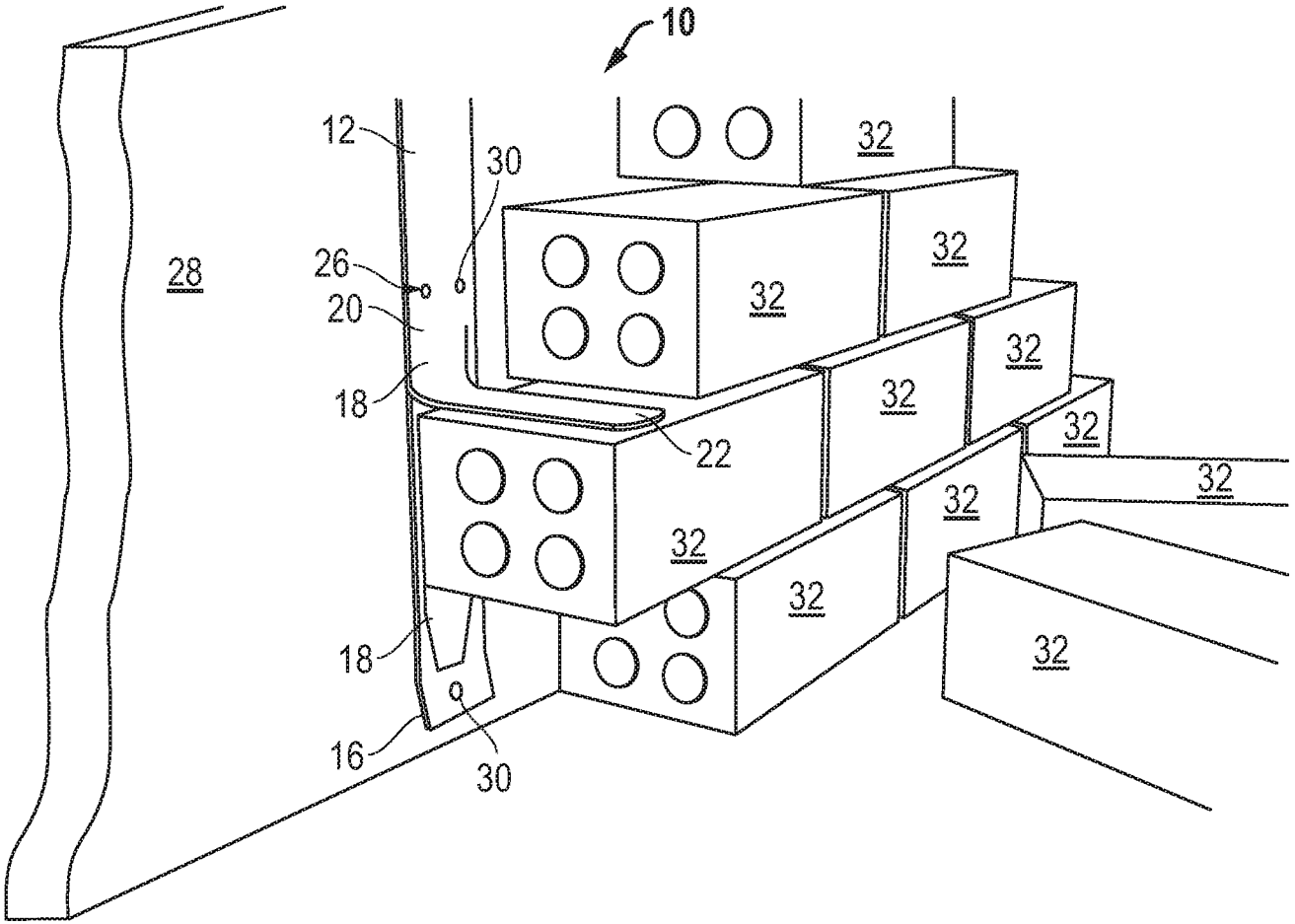
FIG. 3 is a perspective view of the invention of FIG. 1 illustrating the use of the invention including attachment to a structure and the extension of the disconnected anchor away from the hanger and use of the anchor in-between bricks.

Referring now to FIG. 3, a portion of hanger 12 is shown attached with nails 30 in holes 26 to a structure (wall) 28. An anchor 18 has the second part 22 bent away from the hanger 12 and inserted between two bricks 32. In use, once the hanger 12 is located properly in relation to the bricks 32, each anchor 18 as a result of being evenly spaced apart along the length "L" of the hanger 12 ensures that the anchors 18 are always at the correct location for this use. Further, the anchor 18 has a length from the first part 20 and second part 22 so that allows flexibility for placement of the anchor 18 between the bricks 32. That is, a little or a lot of the second part 22 can be detached from the hanger 12 if the location of the hanger 12 is not exactly aligned with the bricks 32.

Figure 4:
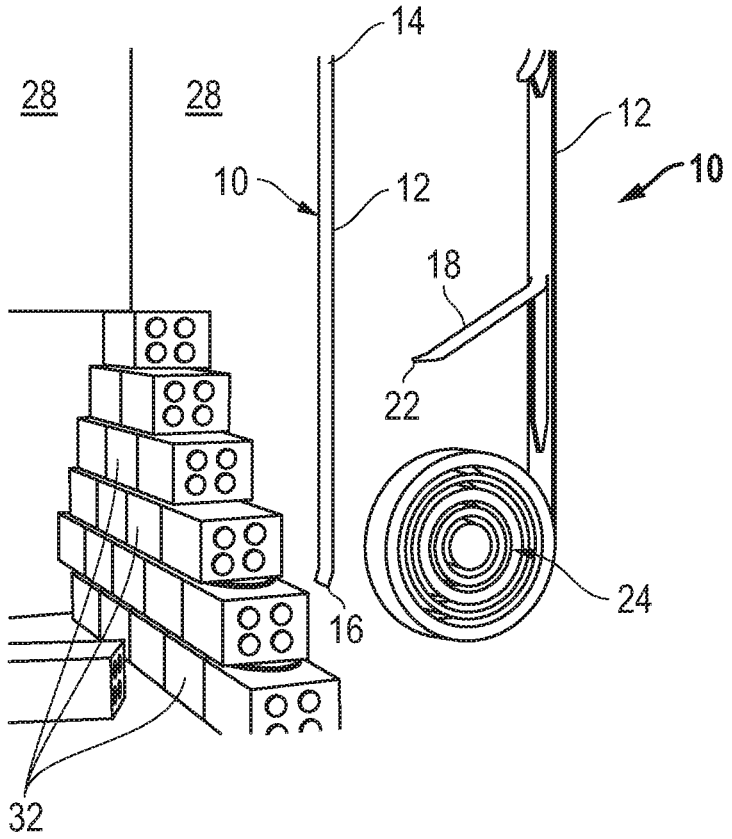
FIG. 4 is a perspective view of the invention of FIG. 1 extended flat besides a wall prior to use and in partially unrolled from with an anchor extended for use.

FIG. 4 shows a flat section of hanger 12 attached to structure 28 in relation to bricks 32 for use as described above. Next to the flat section of hanger 12 is a roll 24 of anchor apparatus 10 partially unrolled and with an anchor 18 extended from the hanger 12 ready for use with bricks 32.

Figure 5:
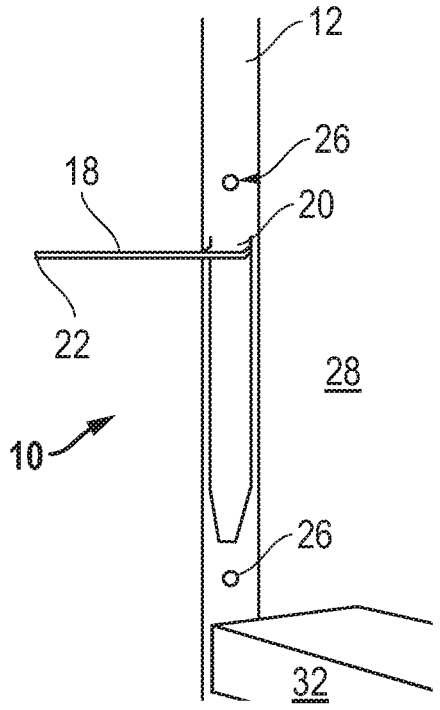
FIG. 5 is a perspective view of a portion of the invention of FIG. 1 unrolled and in place next to a brick with an anchor extended.

FIG. 5 shows a section of hanger 12 with a single anchor 18 extended from the hanger 12 and in position for use with securing brick 32 to structure 28.

Figure 6:
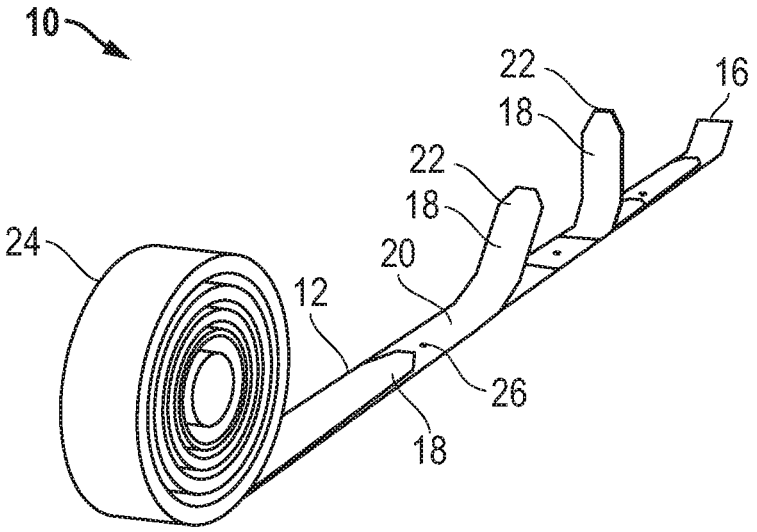
FIG. 6 is a perspective view of the invention of FIG. 1 in partially rolled and extended form with several anchors extended.

FIG. 6 shows a roll 24 of anchor apparatus 10 with a portion of the hanger 12 unrolled and showing the anchors 18 un-extended, flat, and extended with the second part 22 pulled out and extended for use.

Figure 7:
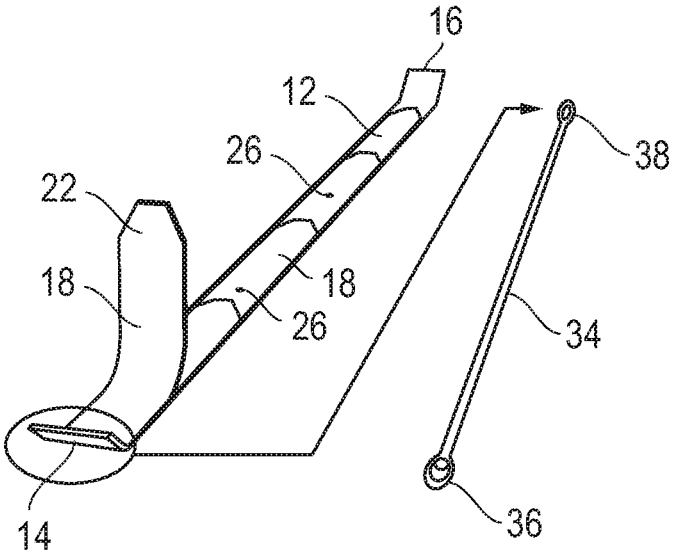
FIG. 7 is a view of a section of the invention of FIG. 1 in relation to a wire suspension device.

FIG. 7 shows another aspect of the invention, a wire suspension device 34 where the wire suspension device 34 is configured for connection with the hanger 12. In some cases, it is useful not to unroll a large length of anchor apparatus 12 because there is no need for anchors 18 in that portion of a structure 28, for example only. In this case, the first end 14 of hanger 12 is connected with the wire suspension device 34. Wire suspension device 34 is a length of wire, or the like, used by attaching one end, connection end 36, to a structure and extending the wire suspension device 34 along a structure 28 to the location where the anchor apparatus 10 is to be used, ie where the masonry/bricks 32 begin. At that point, first end 14 of hanger 12 is connected to the suspension end 38 of the wire suspension device 34 as illustrated.

Figure 8:
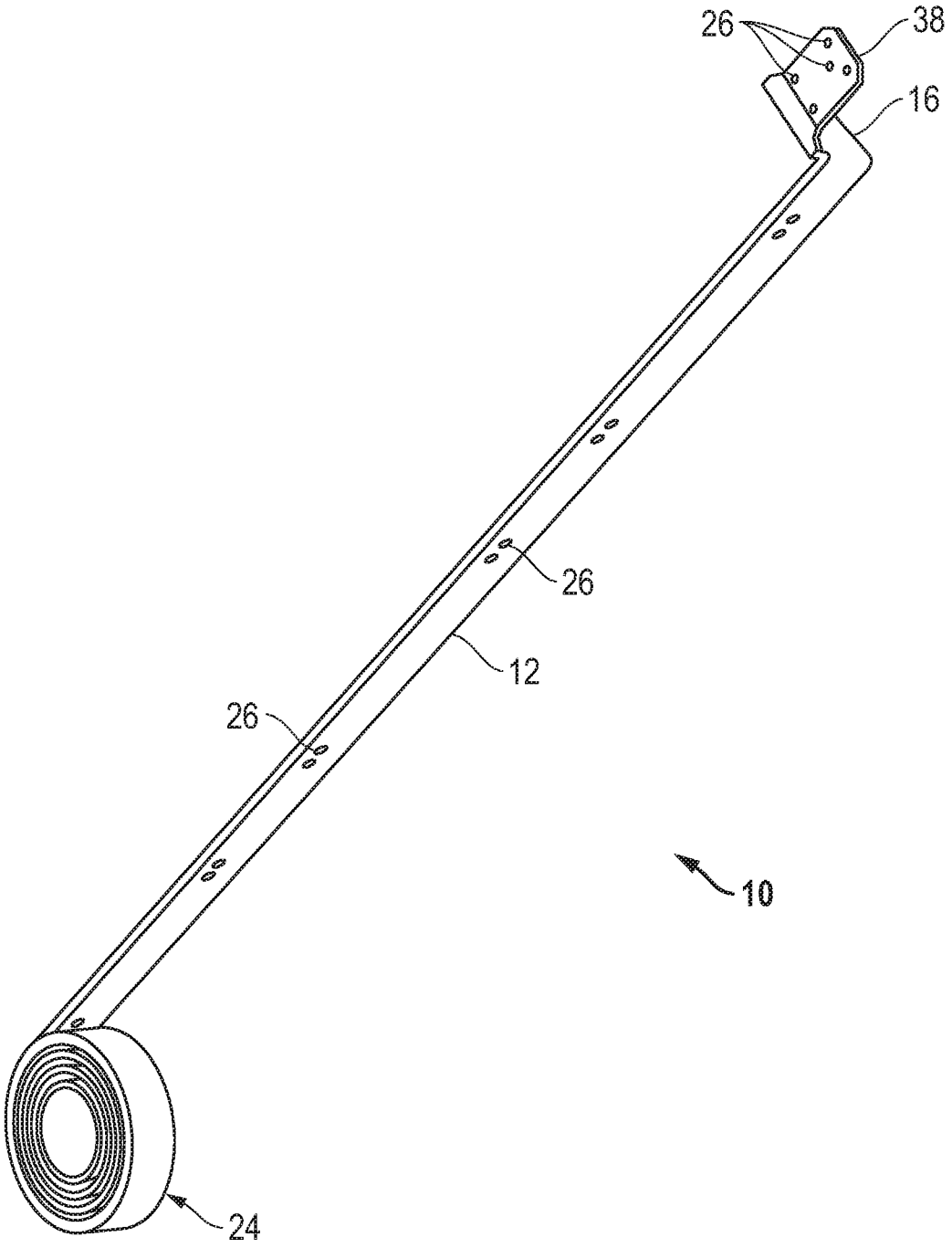
FIG. 8 is a perspective view of the invention of FIG. 1 partially unrolled and including a connection tab extending from one end of the hanger.

Referring now to FIG. 8, anchor apparatus 10 is shown with a roll 24 partially un-rolled with a length "L" of hanger 12 extended. In this aspect, a connection tab 38 is shown at the second end 16. Connection tab 38 is useful in situation where it is useful to fully secure the second end 16 to a structure 28 not shown such as a roof for example only. Preferably, connection tab 38 includes nail holes 26 as well and is located perpendicular to the second end 16 as shown. This structure, the perpendicular location and the holes 26, has been found to be most useful.

By way of further description, Applicant has cleverly invented an apparatus for use in the construction industry by brick masons, for example only and not by limitation, to connect the internal and external walls constructed of bricks or cement blocks together, making the parts to act as a homogeneous unit. Applicant's new approach, by way of the present invention, to "brick ties" is preferably manufactured on a roll, which extends to a flat plate and is connectable to a wire suspension device as described above.

The preferable dimensions of the anchor apparatus 10 are: Width Height Length Equally Spacing; 1/16th or 1/8th inches, 9-10 Foot; 7-8 inches 2 Feet or 25 inches. The preferred materials are: Galvanized metal/tin including perforated holes to nail anchor to walls and flexible metal strip. The preferred length of the anchor is 1¾ inches and the preferred shape of the second part is a "moon" shape as illustrated.

FIG. 1 is an illustration of the anchor apparatus 10 in use within the cavity wall to demonstrate how the hanger 12 is situated between the internal and external walls.

FIG. 3 is an illustration of the invention in use during the application of the product from rollout, full extension, position in the wall cavity, and the anchor between the internal wall and bricks.

FIGS. 6 and 7 illustrate the anchor apparatus in greater details with an emphasis on the flexible roll and extended metal anchors; the flat metal anchors with perforated edges extended and nail holes highlighted; and the wire model to demonstrate the hanging mechanisms for the roll and flat anchors to attach with the nail holes emphasized at each end of the roll.

By way of further description, the anchors of the present invention are utility products that are used in the construction industry specifically in the residential and commercial building and used by the construction trades. The anchors may be considered as three products used to secure internal and external walls constructed of bricks or cement blocks together to ensure the two act as a homogenous unit. The roll anchor 10 is the initial product and includes a unique design and flexibility to ensure durability and accurate applications. Building on the roll anchor is the flat anchor for use when preferring a more stable but accurate anchoring application. To add more strength to the process to connect multiple wythes of masonry; the wire suspension device fits with both the roll and flat anchor systems by folding over the metal at the top of each to the wire suspension device. The wire suspension device creates greater strength to the anchoring of walls while also allowing for adjustments to accommodate various wall heights.

The present invention is preferably constructed with flexible and sturdy galvanized metal/tin, the roll and flat anchors contain perforated anchors to easily pull each from the hanger as well as pre-drilled holes to nail the tin into the wood. The roll and flat anchor metal/tin can be cut easily away from the strip once the height is reached to ensure accurate measurements.

The unique anchor design of the present invention creates efficiency during the installation by decreasing the amount of time a mason will spend attaching individual anchors to secure the wall by the using the 'roll anchoring" system. Because the anchor apparatus 10 uses a flexible strip of galvanized metal/tin with a continuous row of anchors, it will take one-hour to install versus the current one day installation.

The present invention provides several benefits:

1. The anchor apparatus provides durability by using a flexible metal/tin strip, continuous rows and accurate spacing to ensure exact installations based on industry standards.
2. The anchor apparatus can be used to adjust to various wall heights.
3. The design and consistent spacing of the anchors on the hanger reduces the amount of time to install versus the traditional method installing one anchor at a time.
4. The anchors of the present invention build a stronger wall and offer greater stability using the strip of anchors versus individual ties and human mistakes.
5. The anchor apparatus design allows for flexible usage in tight and unusual spaces.

The description of the present embodiments of the invention has been presented for purposes of illustration, but is not intended to be exhaustive or to limit the invention to the form disclosed. Many modifications and variations will be apparent to those of ordinary skill in the art. As such, while the present invention has been disclosed in connection with an embodiment thereof, it should be understood that other embodiments may fall within the spirit and scope of the invention as defined by the following claims.

What is claimed is:

1. An anchor apparatus comprising:

a hanger configured to be connected to an underlying building surface, wherein said hanger has a continuous uninterrupted length having planar top and bottom surfaces, two equally spaced apart sides, and a first end and a second end; and an anchor integrally positioned in said hanger, wherein said anchor is fixedly connected with said hanger along a first part of said anchor and wherein said anchor is releasably connected with said hanger along a second part of said anchor, and wherein said second part has two parallel sides and a tapered end, wherein, in a deployed configuration:

said second part is disconnected from said hanger, said second part of said anchor extends away from said planar top surface of said hanger, and said second part is configured to support a building structure:

wherein, in a stowed configuration, said hanger and said anchor are co-planar.

2. The apparatus of claim 1 further including a plurality of said anchors along the length of said hanger.

3. The apparatus of claim 1 wherein said hanger is flexible such that said hanger is configurable into a roll of hanger and extensible into a length of hanger.

4. The apparatus of claim 1 further including a wire suspension device wherein said wire suspension device is configured for connection with said hanger.

5. The apparatus of claim 1 wherein there are more than one anchors on said hanger that are equally spaced apart along said hanger.

6. The apparatus of claim 1 further including a hole in said hanger.

7. The apparatus of claim 6 wherein there are more than one holes in said hanger along the length of said hanger.

8. The apparatus of claim 6 wherein the hole is located in the hanger outside of the anchor.

9. The apparatus of claim 8 wherein there are a plurality of holes and anchors in said hanger wherein each of said plurality of holes is located in the hanger and in-between the plurality of anchors along the hanger.

10. An anchor apparatus comprising:

a hanger configured to be connected to an underlying building surface, wherein said hanger has a continuous uninterrupted length having planar top and bottom surfaces, two equally spaced apart sides, and a first end and a second end; and a plurality of anchors integrally positioned in said hanger and equally spaced apart along the length of said hanger, wherein each of said plurality of anchors are fixedly connected with said hanger along a first part of each said anchor and wherein each said anchor is releasably connected with said hanger along a second part of ea said anchor, and wherein each said second part has two parallel sides and a tapered end, wherein, in a deployed configuration:

each said second part is disconnected from said hanger, each said second part extends away from said planar top surface of said hanger, and each said second part is configured to support a building structure, wherein, in a stowed configuration, said hanger and said plurality of anchors are co-planar;

a suspension device, wherein said suspension device includes a first end and a second end, wherein the first end of the suspension device is configured to be connected with said hanger and the second end of the suspension device is configured to be connected with the building structure; and a connecter tab located at one end of the hanger, wherein the connector tab extends away from and is perpendicular to the hanger.

11. The apparatus of claim 10 wherein said hanger is flexible such that said hanger is configurable into a roll of hanger and extensible into a length of hanger.

12. The apparatus of claim 10 wherein the suspension device is a length of wire.

13. The apparatus of claim 10 wherein the connector tab includes a hole.

14. The apparatus of claim 10 further including a hole in said hanger.

15. The apparatus of claim 14 wherein there are more than one holes in said hanger along the length of said hanger.

16. The apparatus of claim 14 wherein there are a plurality of holes in said hanger wherein each of said plurality of holes is located in the hanger and in-between the plurality of anchors along the hanger.

17. An anchor method comprising:

providing the anchor apparatus of claim 1;

attaching said hanger to the building surface; and disconnecting said second part of said anchor from said hanger and extending said second part away from said planar top surface of said hanger.

18. The method of claim 17 further including placing said second part of said anchor in-between two bricks.

19. The method of claim 17 further including a wire suspension device wherein said wire suspension device is configured for connection with said hanger and connecting said wire suspension device with said hanger.

20. The method of claim 17 further including a plurality of holes in said hanger wherein each of said plurality of holes is located in the hanger and in-between a plurality of anchors along the hanger.

* * * * *